US005667401A

United States Patent [19]

Kuwabara et al.

[11] Patent Number: 5,667,401

[45] Date of Patent: Sep. 16, 1997

[54] CABLE CONNECTOR, CIRCUIT BOARD AND SYSTEM HAVING CIRCUIT BOARDS CONNECTED TOGETHER BY THE CABLE CONNECTOR

[75] Inventors: Kiyoshi Kuwabara; Tetsuro Yamada; Takeshi Nishiyama; Masahiko Sakuraoka, all of Kawasaki, Japan

[73] Assignee: Fujitsu Limited, Kawasaki, Japan

[21] Appl. No.: 455,532

[22] Filed: May 31, 1995

[30] Foreign Application Priority Data

May 31, 1994 [JP] Japan ..... 6-118530

[51] Int. Cl.[6] ..... H01R 9/09

[52] U.S. Cl. ..... 439/405; 439/82; 439/494; 439/502; 439/682

[58] Field of Search ..... 439/404, 405, 439/499, 502, 682, 924.1, 74, 82, 172, 851, 852

[56] References Cited

U.S. PATENT DOCUMENTS

| | | | |
|---|---|---|---|
| 3,432,795 | 3/1969 | Jayne | 439/924.1 |
| 4,201,432 | 5/1980 | Chalmers | 439/82 |
| 4,764,122 | 8/1988 | Sorel et al. | 439/74 |
| 4,767,350 | 8/1988 | Cooper et al. | 439/851 |
| 4,859,198 | 8/1989 | Owen | 439/852 |
| 4,900,258 | 2/1990 | Hnatuck et al. | 439/502 |
| 5,112,234 | 5/1992 | Johnson et al. | 439/82 |
| 5,427,546 | 6/1995 | Garritano et al. | 439/502 |

FOREIGN PATENT DOCUMENTS

| | | | |
|---|---|---|---|
| 2131631 | 6/1984 | United Kingdom | 439/172 |

*Primary Examiner*—Gary E. Elkins

*Attorney, Agent, or Firm*—Armstrong, Westerman, Hattori, McLeland & Naughton

[57] ABSTRACT

A cable connector includes cables, and jacks attached to ends of the cables. The jacks have contacts connected to the cables. The contacts extend in a first direction substantially perpendicular to a second direction in which the cables extend from the jacks.

19 Claims, 12 Drawing Sheets

CABLE CONNECTOR, CIRCUIT BOARD AND SYSTEM HAVING CIRCUIT BOARDS CONNECTED TOGETHER BY THE CABLE CONNECTOR

BACKGROUND OF THE INVENTION

1. Field of the Invention

The present invention generally relates to cable connectors for electrically connecting circuit boards, and more particularly a cable connector for electrically connecting circuit boards arranged at an identical level, i.e., co-extensive.

Recently, it has been required that parts such as circuit boards are provided with a high density due to the demand for down-sizing of electronic devices such as computers. Therefore, it is necessary to provide an improved highly efficient transfer structure that transfers signals between circuit boards. Such a signal transfer structure is a cable connector for connecting circuit boards together. Particularly, it is required that a cable connector connecting circuit boards arranged on a co-extensive level with each other occupies a small mounting area and has a short length.

2. Description of the Prior Art

A prior art structure will be described with reference to FIGS. 1 and 2 in order to facilitate an understanding of the present invention.

FIG. 1 shows a conventional cable connector for electrically connecting circuit boards together. A first plug 2 is provided to a first circuit board 1. The first plug 2 has pins 8 that stand substantially upright on the first circuit board 1. A second plug 4 is provided to a second circuit board 3. The second plug 4 has pins 9 that stand substantially upright on the second circuit board 3. A first jack 5 has contacts 5', which engage the pins 8 of the first plug 2. A second jack 6 has contacts 6', which engage pins 9 of the second plug 4. A cable 7 connects the contacts 5' of the first jack 5 and the contacts 6' of the second jack 6 together. When the first jack 5 vertically engages the first plug 2, the contacts 5' contact and engage with the pins 8. Similarly, when the second jack 6 vertically engages the second plug 4, the contacts 6' contact and engage with the pins 9.

FIG. 2 shows another conventional cable connector for electrically connecting circuit boards together. A first plug 12 is connected to a first circuit board 11 so that pins 18 thereof extend parallel to the circuit board 11. A second plug 14 is provided to a second circuit board 13 so that pins 19 thereof extend parallel to the circuit board 13. A first jack 15 has contacts 15', which engages the pins 18 of the first plug 12. The second jack 16 has contacts 16', which engage pins 19 of the second plug 14. A cable 17 connects the contacts 15' of the first jack 5 and the contacts 16' of the second jack 16 together. When the first jack 15 horizontally engages the first plug 12, the contacts 15' contact and engage with the pins 18. When the second jack 16 horizontally engages the second plug 14, the contacts 16' contact and engage with the pins 9.

However, the conventional cable connector shown in FIG. 1 has a disadvantage in that there is a section of the cable 7 which is bent upwards thereby increasing the length of the cable. This causes a time delay in transferring signals between the circuit boards 1 and 3.

The conventional cable connector shown in FIG. 2 has a disadvantage in that it requires a side space between the circuit boards 11 and 13 due to the presence of the first jack 15 and the second jack 16. Accordingly, the type of connector requires a large mounting space.

SUMMARY OF THE INVENTION

It is a general object of the present invention to provide a cable connector and a circuit board equipped with the same in which the above disadvantages are eliminated.

A more specific object of the present invention is to provide a cable connector and a circuit board which reduces delay time in transferring signals between circuit boards and which only requires a small space is needed between the circuit boards.

The above objects of the present invention are achieved by a cable connector comprising:

cables; and jacks attached to ends of the cables, the jacks having contacts connected to the cables, the contacts extending in a first direction substantially perpendicular to a second direction in which the cables extend from the jacks.

According to one aspect of the present invention, each of the jacks comprises: a jack housing having a hollow area; and jack modules having the contacts and portions which are in contact with cores of the cables.

According to another aspect of the present invention, the portions of the jack modules have engagement portions defining slits; and the cores of the cables are inserted into the slits and are in contact with the engagement portions.

According to yet another aspect of the present invention, the cores of the cables are in contact with the portions of the jack modules and the jack housing, so that the cores of the cables are pressed to the portions of the jack modules by the jack housing.

According to a further aspect of the present invention, the cores of the cables are fixed to the portions of the jack modules by soldering.

According to another aspect of the present invention, each of the jacks has step portions; and the cables are aligned in each of the step portions.

According to another aspect of the present invention, the cables are supported by a member so that the cables are integrally formed.

According to another aspect of the present invention, the cables are isolated cables separated from each other.

According to another aspect of the present invention, the cables are cables of a flexible printed circuit board.

According to another aspect of the present invention, the cables are cables of a thin-film circuit board.

According to another aspect of the present invention, the jack modules have projections and recesses; and adjacent jack modules engage with each other by the projections and recesses.

The above objects of the present invention are also achieved by a circuit board comprising:

a board on which a circuit is formed; and a plug mounted on the board, the plug having pins projecting from the board in a first direction, the plug being connectable to a cable connector comprising:

cables; and jacks attached to ends of the cables, the jacks having contacts connected to the cables, the contacts extending in the first direction substantially perpendicular to a second direction in which the cables extend from the jacks.

According to yet another object of the present invention is to provide a system having a cable connector and a circuit board as described above. More particularly, the system a system comprising:

first and second circuit boards, each of which comprising a board and a plug mounted thereon, the plug having pins projecting from the board in a first direction; and a cable connector comprising:

cables; and jacks attached to ends of the cables, the jacks having contacts connected to the cables, the contacts extending in the first direction substantially perpendicular to a second direction in which the cables extend from the jacks.

BRIEF DESCRIPTION OF THE DRAWINGS

Other objects, features and advantages of the present invention will become more apparent from the following detailed description when read in conjunction with the accompanying drawings, in which.

DESCRIPTION OF THE PREFERRED EMBODIMENTS

Figure 3A:
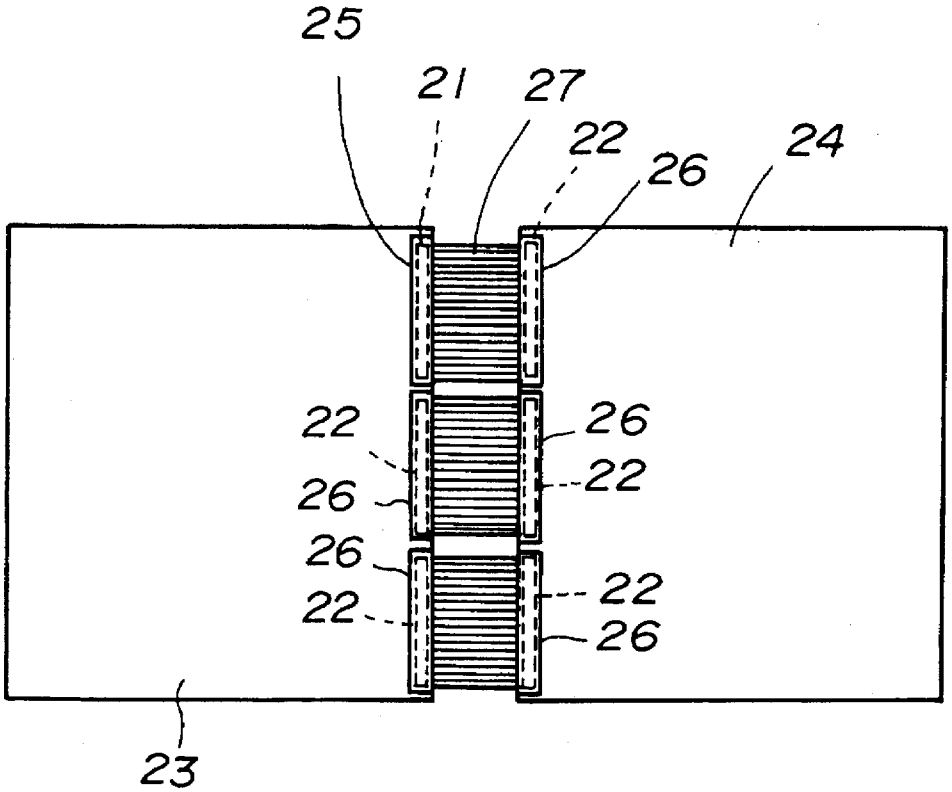
FIGS. 3A and 3B are diagrams of an outline of the present invention.
Figure 3B:
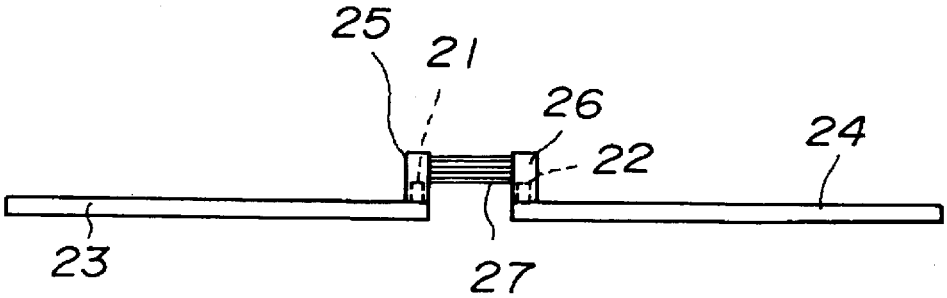

FIGS. 3A and 3B show an outline of the present invention. More particularly, FIG. 3A is a plan view of a cable connector connecting two circuit boards which are substantially in the same plane, i.e., co-extensive, and FIG. 3B is a side view thereof.

A connector cable includes a cable 27 and two jacks 25 and 26, which engage plugs 21 and 22 formed provided on circuit boards 23 and 24, respectively. In the structure shown in FIGS. 3A and 3B, the circuit boards 23 and 24 are electrically connected together by three cables, also provided are three plugs 21 and three plugs 22. The plugs 21 are attached to an end of the circuit board 23 which may be a printed circuit board, and the plugs 22 are attached to an end of the circuit board 24 which may be a printed circuit board. Each of the plugs 21 has pins that stand upright on the circuit board 23. Similarly, each of the plugs 22 has pins that stand upright on the circuit board 24. Each of the jacks 25 and 26 has contacts, which can engage the pins of the corresponding plug 21 and 22, respectively. Similarly, each of the jacks 26 has contacts, which can engage the pins of the corresponding plug 22. Each of the cables 27 has a plurality of lines which are integrally formed. These lines vertically extend from the jacks 25 and 26.

Figure 1:
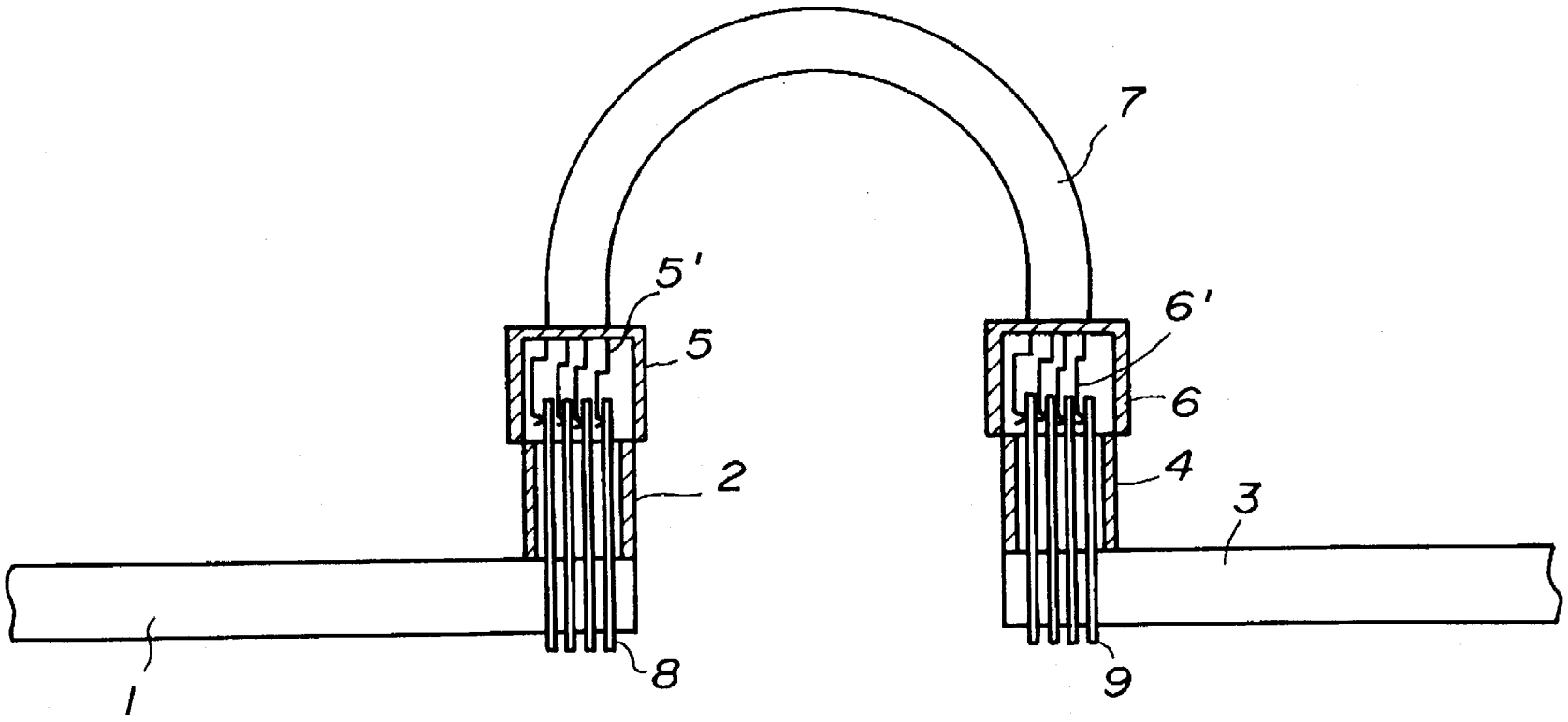
FIG. 1 PRIOR ART
FIG. 1 is a diagram of a conventional cable connector.
Figure 2:
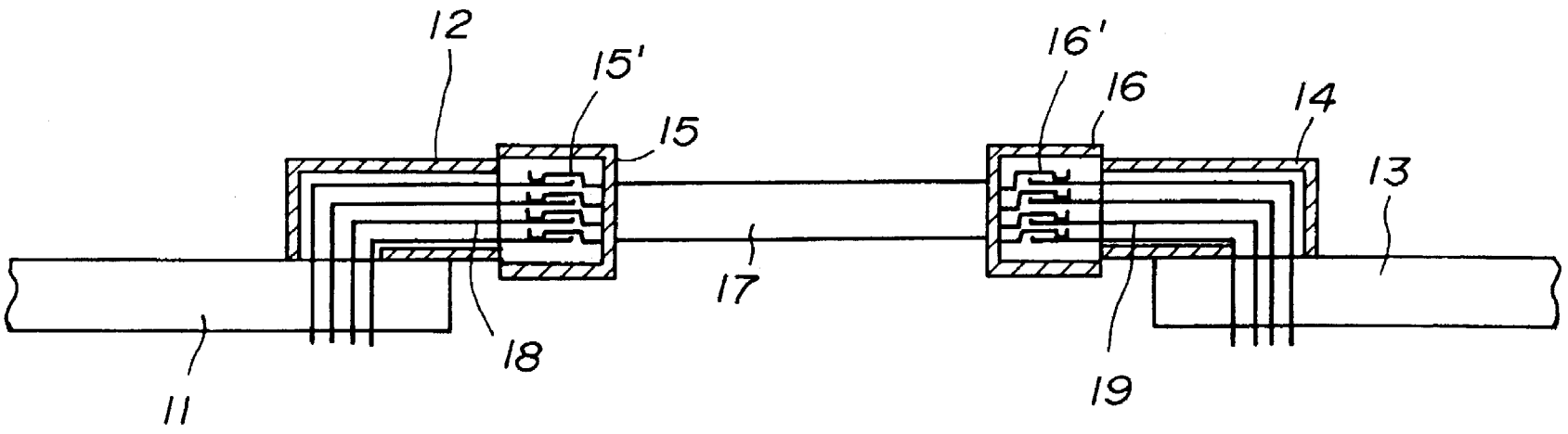
FIG. 2 PRIOR ART
FIG. 2 is a diagram of another conventional cable connector.

When the jacks 25 and 26 engage the plugs 21 and 22, respectively, the jacks 25 and 26 do not horizontally project from the circuit boards 23 and 24. Further, the cables 27 extend horizontally, and are not bent as shown in FIG. 1. Hence, it is possible to arrange the circuit boards 23 and 24 close to each other and eliminate the disadvantages of the conventional arrangements shown in FIGS. 1 and 2. That is, the shorter length of the cables 27 reduces delay in transferring signals between the circuit boards 23 and 24.

Figure 4:
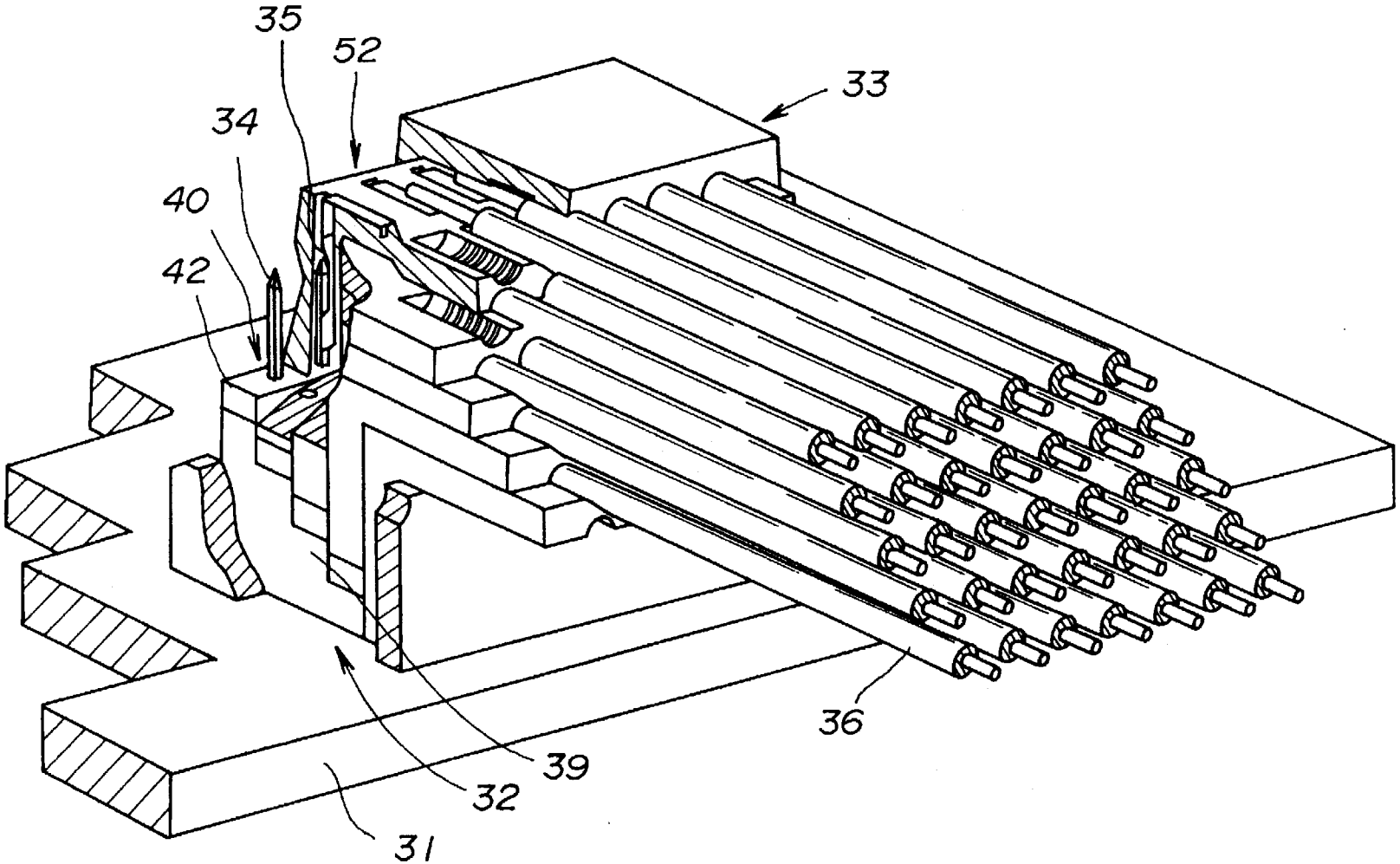
FIG. 4 is a perspective view of an embodiment of the present invention.

FIG. 4 is a perspective view of an embodiment of the present invention. A plug 32 is provided on a circuit board 31, such as a printed circuit board. A jack 33 is engageable with the plug 32. The plug 32 has a plurality of pins 34, which substantially stand upright on the circuit board 31. The jack 33 has a plurality of contacts 35, which can engage the pins 34 of the plug 32. A group of isolated cables 36 is connected to the contacts 35 of the jack 33. The cables 36 substantially vertically protrude from the surface on which the contacts 35 are provided. The contacts 35 extend in a first direction approximately perpendicular to a second direction in which the cables 36 extend from the jack 33.

The pins 34 provided in the plug 32 are stepwise arranged, and are aligned at identical pitches in each step. As shown in FIG. 4, the steps ascend from the end of the circuit board 31. The contacts 35, engageable with the pins 34, are stepwise arranged to correspond with the stepwise arrangement of the pins 34. In the stepwise arrangement of the contacts 35, the contacts 35 are aligned at identical pitches in each step.

Figure 5:
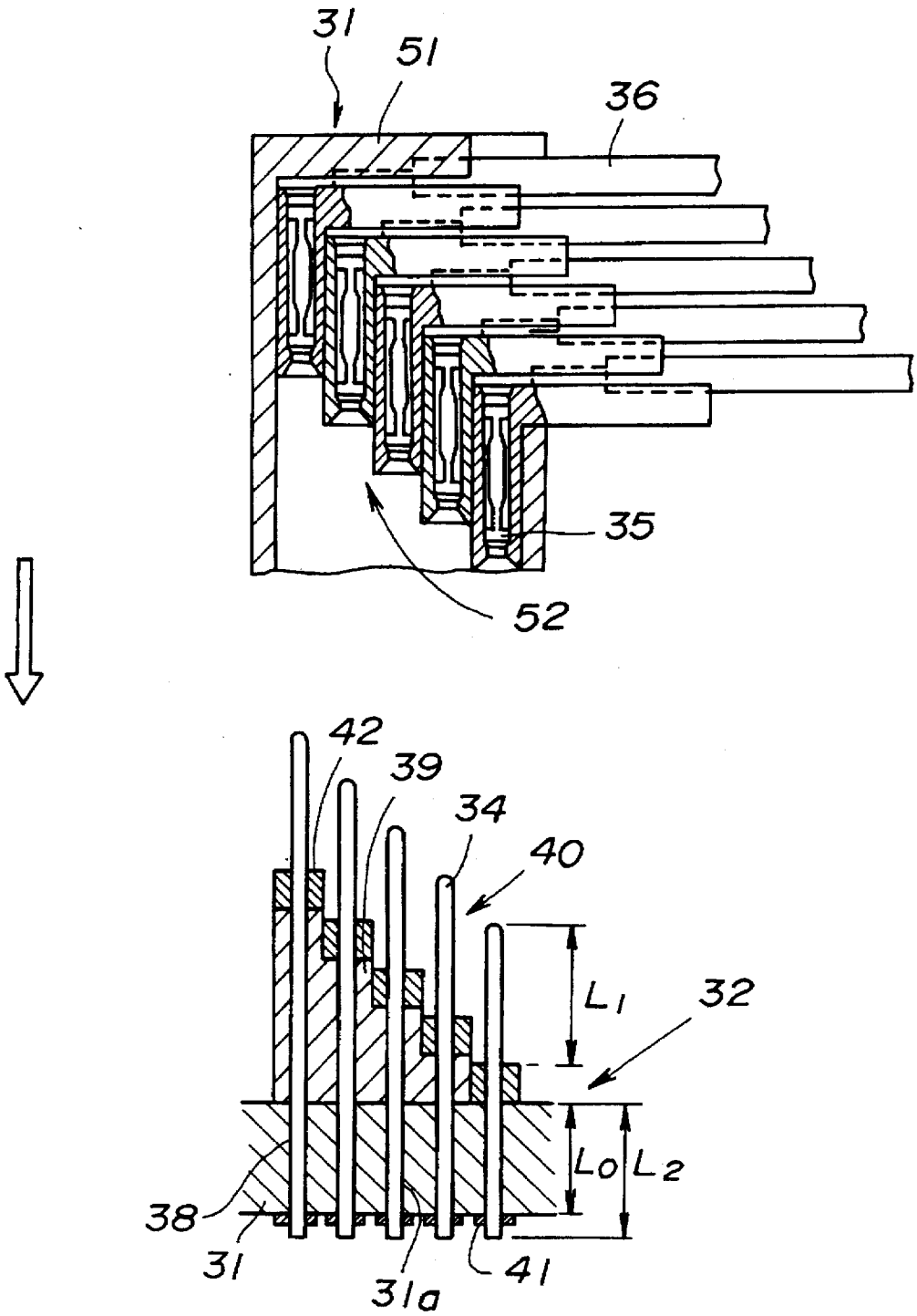
FIG. 5 is a cross-sectional view of a plug and jack shown in FIGS. 3A and 3B.
Figure 6B:
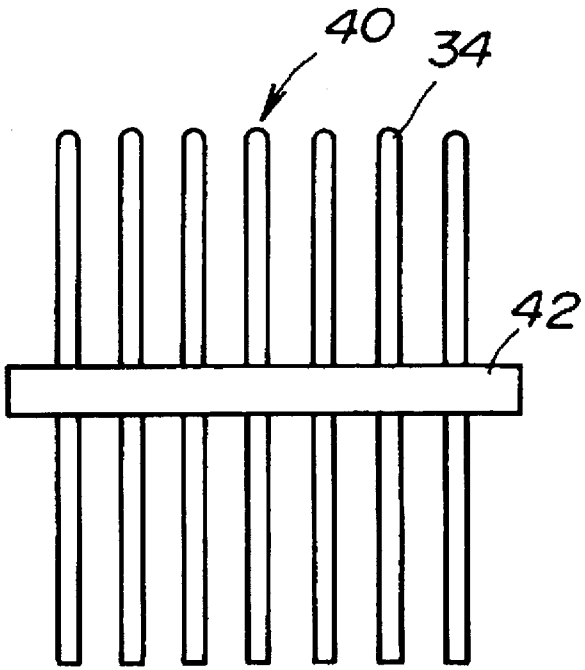
FIG. 6B is a front view of the plug module shown in FIG. 6A.
Figure 6A:
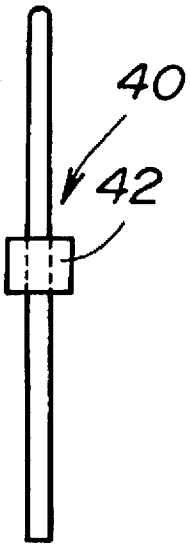
FIG. 6A is a side view of a plug module used in the embodiment of the present invention.
Figure 8:
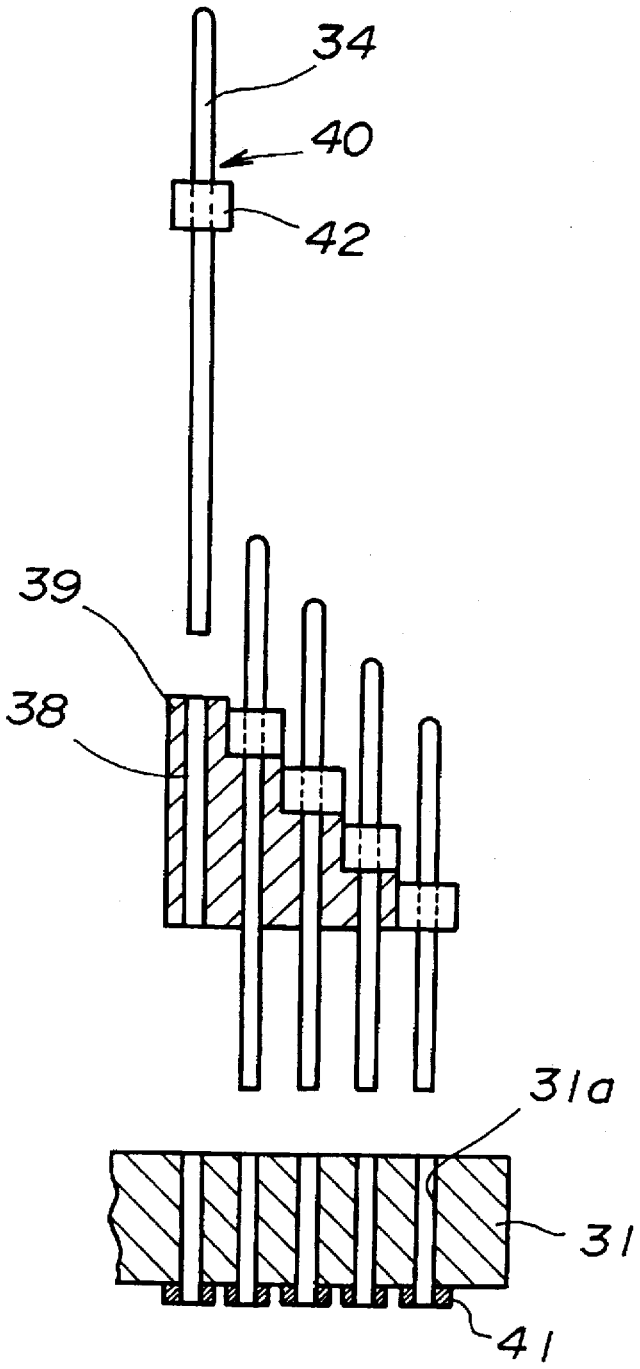
FIG. 8 is a diagram showing a way of attaching the plug used in the embodiment of the present invention.

A further description will be given, with reference to FIGS. 4 through 6 and FIG. 8. FIG. 5 shows a cross-sectional view of the plug 32 and the jack 33 shown in FIG. 4. FIG. 6A is a side view of parts of a plug module, and FIG. 6B is a front view thereof. Further, FIG. 8 shows how the plug 32 is attached.

A stepwise plug housing 39 is provided on the circuit board 31. The stepwise plug housing 39 has step portions in which through holes 38 are formed. The pins 34 are inserted in the through holes 38. Pin plates 42 are provided on the respective steps of the housing 39. As shown in FIGS. 6A and 6B, in each of the steps, the pin plate 42 supports the pins 34 which are aligned at identical pitches, so that a plug module 40 is formed. The plug module 40 is provided to each of the steps of the housing 39. The pin plate 42 can be formed by molding. As shown in FIG. 8, the pin plates 42 are placed on the steps of the housing 39 so that the pins 34 are inserted into the holes 38 and project from the bottom surface of the plug housing 39.

As shown in FIG. 5, through holes 31*a* for accommodating the pins 34 are formed in the circuit board 31. A plurality of lands 41 for soldering are formed on the surface of the circuit board 31 opposite to the surface thereof on which the plug 32 is mounted. The end portions of the pins 34 slightly project from the lands 41 located in the vicinity of the ends of the holes 31*a*.

As shown in FIG. 5, the pins 34 have different lengths in the different steps of the plug housing 39. However, the upper portions of the pins 34 projecting from the pin plates 42 have an identical length L1. Hence, the lower portions of the pins 34 below the pin plates 42 have different lengths L2 for the different steps. The lengths L2 of the lower portions of the pins 34 is greater than the thickness L0 of the circuit board 31.

Figure 7B:
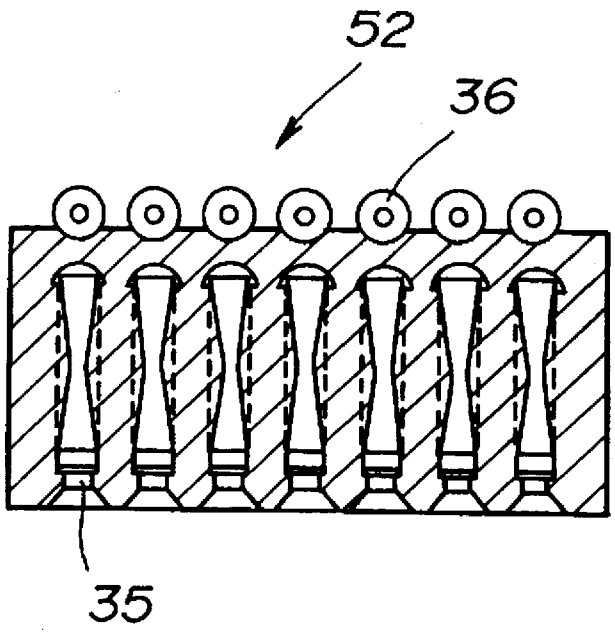
FIG. 7B is a cross-sectional view taken along a line A—A shown in FIG. 7A.
Figure 7A:
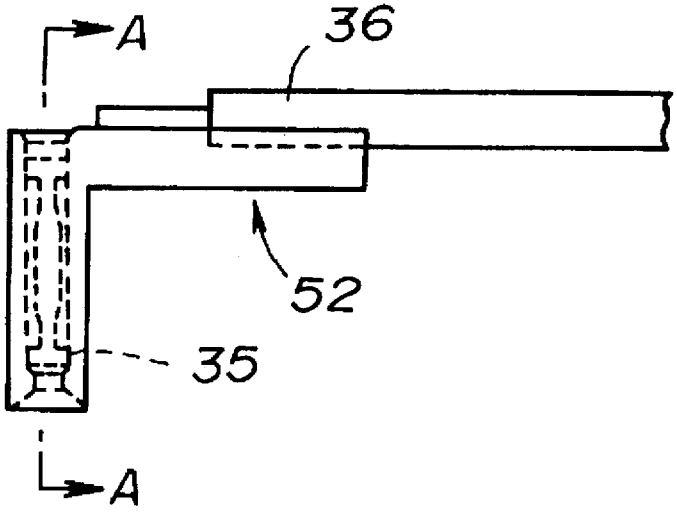
FIG. 7A is a side view of a jack module used in the embodiment of the present invention.
Figure 9:
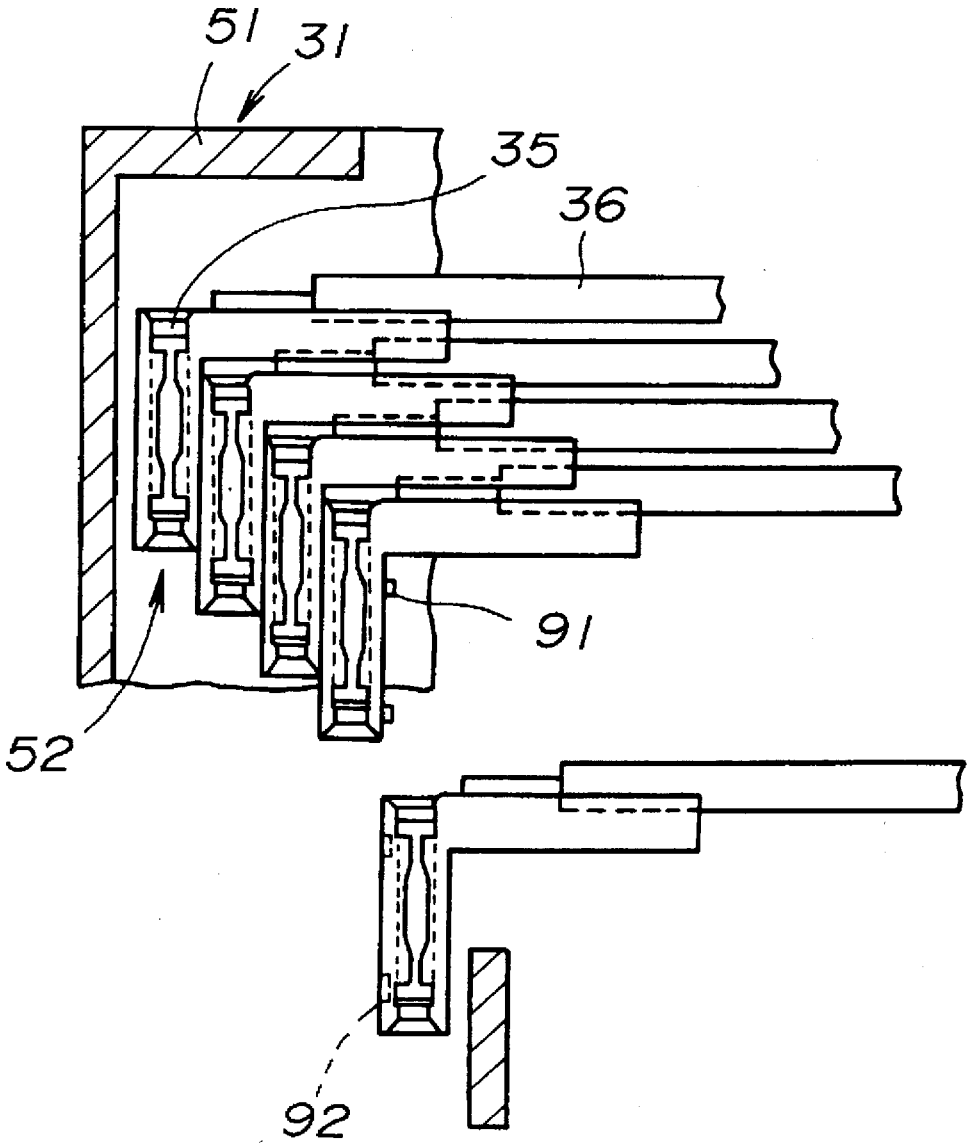
FIG. 9 is a diagram showing a way of attaching the jack used in the embodiment of the present invention.

The jack 34 will be described in detail with reference to FIGS. 4, 5, 7A, 7B and 9. FIG. 7A is a side view of parts of a jack module, and FIG. 7B is a cross-sectional view taken along a line A—A shown in FIG. 7A. FIG. 9 is a diagram showing how the jack 33 is attached.

The jack 33 has a jack housing 51, which has a first opening engaging with the plug housing 39, and a second opening formed in a plane perpendicular to the first opening. Further, the jack housing 51 has an L-shaped hollow area. The contacts 35 are aligned at identical pitches in a first end of the jack housing 51, and jack modules 52, each having an identical L shape, are arranged in a stacked formation in a second end thereof. The cables 36 to be connected to the contacts 35 are connected to the jack modules 52.

Figure 10:
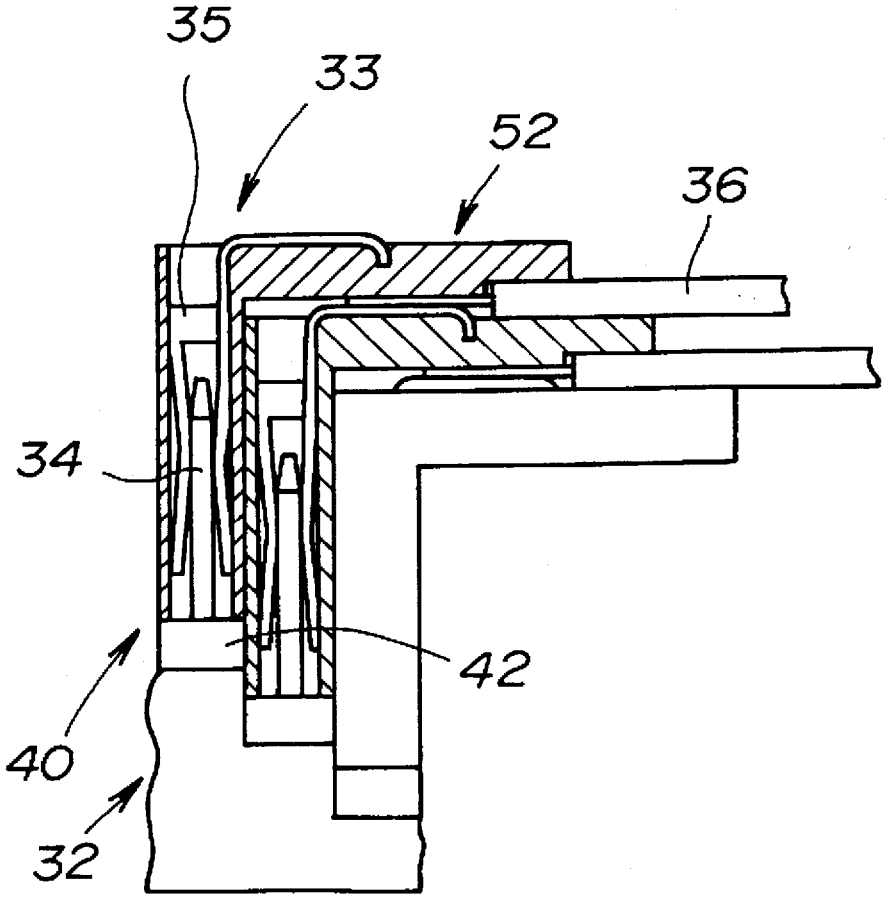
FIG. 10 is a diagram showing an engagement of the plug and jack used in the embodiment of the present invention.

The plug 32 and the jack 33 engages each other, as shown in FIG. 10. When the jack 33 is engaged with the plug 32, the contacts 35 come into contact with the pins 34, so the pins 34 are electrically connected to the cables 36.

According to the above-mentioned embodiment of the present invention, the pins 34 vertically stands on the circuit board 31 so that the jack 33 does not protrude beyond the circuit board 31. Further, the cables 36 extends from the plane substantially perpendicular to the surface on which the contacts 35 are provided. Hence, the cables 36 are not bent between the circuit boards and are short in length. Hence, there is little delay in transferring signals between the circuit boards, which can be thus made close to each other.

By arranging the contacts 35 in the stepwise formation, it is possible to unify the size of the contacts 35. Further, by using the plug modules 40 and the jack modules 52, it is possible to facilitate the extending and assembling operations.

Figure 11C:
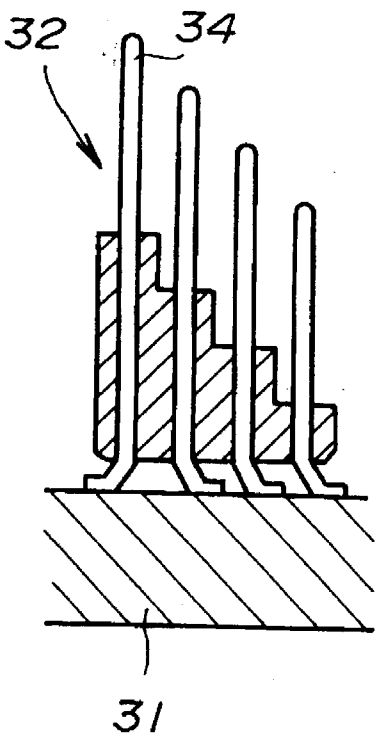
FIGS. 11A, 11B and 11C are diagrams of ways to attach the plug to a circuit board.
Figure 11B:
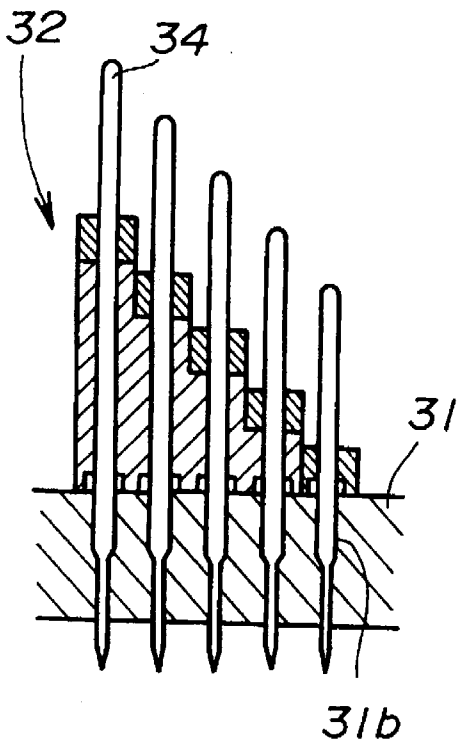
Figure 11A:
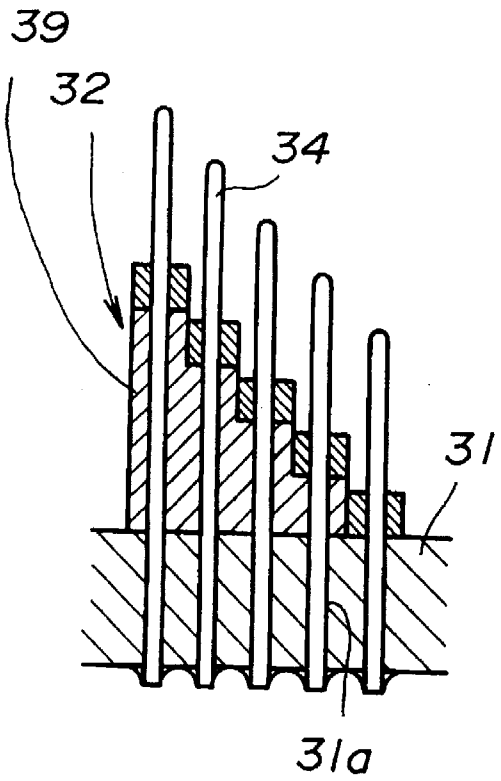

The present invention is not limited to the above-mentioned embodiment of the present invention. For example, there are ways to attach the plug 32 to the circuit board 31 as shown in FIGS. 11A, 11B and 11C. As shown in FIG. 11A, the pins 34 are inserted into the through holes 31*a* of the circuit board 31, and the end portions of the pins 34 are soldered to the lands. In the way shown in FIG. 11B, the pins 34 are inserted, with a pressure, into the through holes 31*a* of the circuit board 31. The way shown in FIG. 11C is to mount the pins 34 of the plug 32 on the circuit board 31.

Figure 12A:
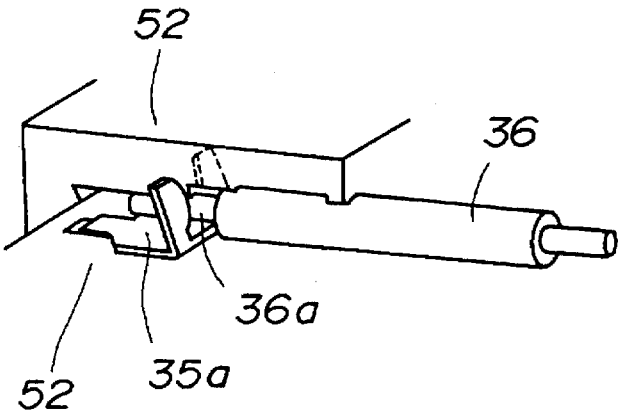
FIGS. 12A, 12B and 12C are diagrams of ways to connect a cable to a contact of a jack module of the jack.
Figure 12B:
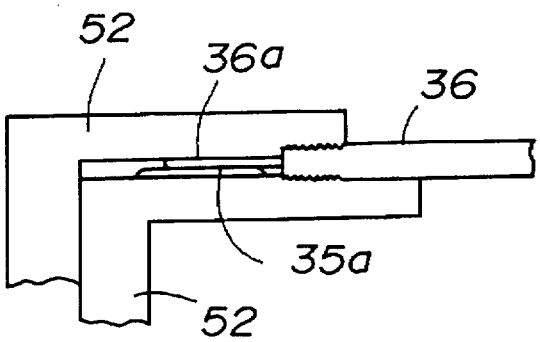
Figure 12C:
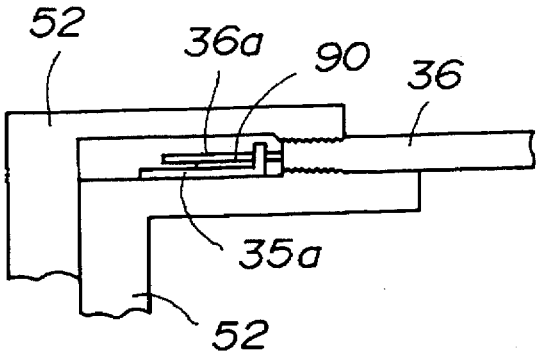

FIGS. 12A, 12B and 12C show ways to connect the cables 36 and the contacts 35 together. In the way shown in FIG. 12A, the jack modules 52 are arranged in a stacked formation. A core 36*a* made of a conductive material of the cable 36 is inserted, with a pressure, into a slit defined by two engagement portions of a jack contact lead portion 35*a*. The way shown in FIG. 12B is such that the core 36*a* of the cable 36 makes a pressure contact with the engagement portions of the jack contact lead portion 35*a* in each of the jack modules 52 stacked. As shown in FIG. 12C, the core 36*a* of the cable 36 is attached to the jack contact lead portion 35*a* by soldering. In this case, in order to prevent stress from being applied to a soldered portion, a gap is formed between the core 36*a* of the cable 36 and the upper portion of the jack module 52.

The cables are not limited to isolated ones in which each core is separately coated by an insulating member made of, for example, vinyl resin. For example, a flexible printed circuit board (FPC) or a thin-film circuit board can be used as cables.

As shown in FIG. 9, small projections 91 and corresponding recesses 92 can be formed. More particularly, some small projections 91 are formed on an outer surface of the jack module 52, and some small recesses 92 are formed on an opposing outer face of the jack module adjacent to the former jack module 52. The projections 91 engage the recesses 92, so that the adjacent jack modules 52 can be fastened to each other and positioning of these modules can be facilitated.

The present invention is not limited to the specifically disclosed embodiment, variations and modifications, and other variations and modifications may be made without departing from the scope of the present invention.

What is claimed is:

1. A cable connector comprising:

cables; and jacks attached to ends of the cables, the jacks having contacts connected to the cables, said contacts extending in a first direction substantially perpendicular to a second direction in which the cables extend from the jacks.

2. The cable connector as claimed in claim 1, wherein each of said jacks comprises:

a jack housing having a hollow area; and jack modules having said contacts and portions which are in contact with cores of said cables.

3. The cable connector as claimed in claim 2, wherein:

said portions of the jack modules have engagement portions defining slits; and the cores of the cables are inserted into said slits and are in contact with said engagement portions.

4. The cable connector as claimed in claim 2, wherein the cores of the cables are in contact with said portions of the jack modules and said jack housing, so that the cores of the cables are pressed to said portions of the jack modules by said jack housing.

5. The cable connector as claimed in claim 2, wherein the cores of the cables are fixed to said portions of the jack modules by soldering.

6. The cable connector as claimed in claim 1, wherein:

each of said jacks has step portions; and the cables are aligned in each of the step portions.

7. The cable connector as claimed in claim 1, wherein said cables are supported by a member so that said cables are integrally formed.

8. The cable connector as claimed in claim 1, wherein said cables are isolated cables separated from each other.

9. The cable connector as claimed in claim 1, wherein said cables are cables of a flexible printed circuit board.

10. The cable connector as claimed in claim 1, wherein said cables are cables of a thin-film circuit board.

11. The cable connector as claimed in claim 2, wherein:

said jack modules have projections and recesses; and adjacent jack modules engage with each other by the projections and recesses.

12. A circuit board comprising:

a board on which a circuit is formed; and a plug mounted on said board, said plug mounted on said board, said plug having pins projecting from the board in a first direction, said plug detachably connected to a cable connector including cables; and jacks attached to ends of the cables, the jacks having contacts connected to the cables, said contacts extending in the first direction substantially perpendicular to a second direction in which the cables extend from the jacks.

13. The circuit board as claimed in claim 12, wherein:

said plug has step portions, and the pins are aligned in each of the step portions; and the pins have different heights from the board for each of the step portions.

14. The circuit board as claimed in claim 12, wherein said plug comprises:

a plug housing which is mounted on the board and has step portions having through holes into which the pins can be inserted; and plug modules respectively having pins aligned, the plug modules being respectively mounted on the step portions.

15. The circuit board as claimed in claim 12, wherein said board has through holes into which the pins are inserted so that end portions of the pins protrude from the board.

16. The circuit board as claimed in claim 15, wherein:

lands for soldering are formed on a first surface of the board opposite to a second surface thereof on which the plug is mounted; and said end portions of the pins are electrically connected to the lands.

17. The circuit board as claimed in claim 12, wherein said board has through holes into which the pins are inserted with a pressure so that end portions of the pins protrude from the board.

18. The circuit board as claimed in claim 12, wherein the pins are mounted on the board.

19. A system comprising:

first and second circuit boards, each of which includes a board and a plug mounted thereon, said plug having pins projecting from the board on which each plug is mounted in a first direction; and cables; connector comprising:

cables; and jacks attached to ends of the cables, the jacks having contacts connected to the cables, said contacts extending in the first direction substantially perpendicular to a second direction in which the cables extend from the jacks.

* * * * *